US008378933B2

(12) United States Patent
Kwak et al.

(10) Patent No.: US 8,378,933 B2
(45) Date of Patent: Feb. 19, 2013

(54) PIXEL AND ORGANIC LIGHT EMITTING DISPLAY DEVICE USING THE SAME

(75) Inventors: Won-Kyu Kwak, Yongin (KR); Chang-Yeop Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 712 days.

(21) Appl. No.: 12/641,315

(22) Filed: Dec. 17, 2009

(65) Prior Publication Data

US 2010/0220040 A1 Sep. 2, 2010

(30) Foreign Application Priority Data

Mar. 2, 2009 (KR) ..... 10-2009-0017540

(51) Int. Cl.
*G09G 3/30* (2006.01)

(52) U.S. Cl. ..... 345/76; 345/45; 345/80

(58) Field of Classification Search ..... 345/76
See application file for complete search history.

(56) References Cited

U.S. PATENT DOCUMENTS

| | | | | |
|---|---|---|---|---|
| 2006/0156121 | A1* | 7/2006 | Chung | 714/726 |
| 2007/0024543 | A1* | 2/2007 | Chung et al. | 345/76 |
| 2007/0085781 | A1* | 4/2007 | Chung et al. | 345/76 |
| 2007/0103406 | A1* | 5/2007 | Kim | 345/76 |
| 2010/0013868 | A1* | 1/2010 | Chung | 345/690 |

FOREIGN PATENT DOCUMENTS

| | | | |
|---|---|---|---|
| KR | 10-2006-0019757 | A | 3/2006 |
| KR | 1020060050856 | A | 5/2006 |
| KR | 10-2007-0029769 | A | 3/2007 |
| KR | 10-2007-0059874 | A | 6/2007 |
| KR | 100805608 | B1 | 2/2008 |

OTHER PUBLICATIONS

Korean Office action dated Nov. 8, 2010, for corresponding Korean Patent Application No. 10-2009-0017540.
KIPO Office action dated Dec. 13, 2011, for Korean priority Patent application 10-2009-0017540, noting references previously submitted in an IDS dated Nov. 23, 2010, and Oct. 6, 2011, 3 pages.
Korean Office action dated Jul. 28, 2011 issued to corresponding priority application 10-2009-0017540, 5 pages.

* cited by examiner

*Primary Examiner* — Adam R Giesy
(74) *Attorney, Agent, or Firm* — Christie, Parker & Hale, LLP

(57) ABSTRACT

A pixel includes an organic light emitting diode (OLED) having a cathode electrode coupled to a second power source, a second transistor coupled to a data line and a first scan line, a first transistor coupled between a second electrode of the second transistor and an anode electrode of the OLED, a third transistor coupled between a gate electrode and a second electrode of the first transistor, a fourth transistor coupled between the gate electrode of the first transistor and an initialization power source, a fifth transistor coupled between a first electrode of the first transistor and a first power source, a first capacitor coupled between the gate electrode of the first transistor and the first power source, and a second capacitor coupled between the gate electrode and the first electrode of the first transistor.

11 Claims, 3 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2009-0017540, filed on Mar. 2, 2009, in the Korean Intellectual Property Office, the entire content of which is incorporated herein by reference.

BACKGROUND

1. Field of the Invention

The present invention relates to a pixel and an organic light emitting display device using the same.

2. Discussion of Related Art

Recently, there have been developed various types of flat panel display devices having reduced weight and volume over cathode ray tubes. The flat panel display devices include a liquid crystal display device, a field emission display device, a plasma display panel, an organic light emitting display device, and the like.

Among these flat panel display devices, the organic light emitting display device displays images using organic light emitting diodes that emit light through recombination of electrons and holes. The organic light emitting display device has a fast response time and is driven with low power consumption. In a conventional organic light emitting display device, light is emitted from an organic light emitting diode by supplying current corresponding to a data signal using a driving transistor formed in each pixel.

In each of the pixels of the conventional organic light emitting display device, a voltage corresponding to a data signal is charged into at least one capacitor, and current corresponding to the charged voltage is supplied from a first power source via an organic light emitting diode using a driving transistor, thereby displaying an image. In this case, the voltage drop of the first power source varies depending on the load (e.g., the number of emitting pixels) of a display unit, and therefore, an unequal image is displayed.

More specifically, the voltage drop of the first power source when k ("k" is a natural number) pixels emit light is different from that of the first power source when k/2 pixels out of the k pixels emit light. In such cases where the voltage drop of the first power source is different, the luminance of each pixel when the k pixels emit light is different from that when the k/2 pixels emit light in response to the same data signal.

SUMMARY OF THE INVENTION

Accordingly, a pixel capable of displaying an image having uniform luminance and an organic light emitting display device using the same is provided according to embodiments of the present invention.

According to an embodiment of the present invention, there is provided a pixel of an organic light emitting display device including a first power source, a second power source, an initialization power source, a data line, a first scan line, a second scan line, and an emission control line, the pixel including an organic light emitting diode having a cathode electrode coupled to the second power source, a second transistor coupled to the data line and the first scan line, the second transistor being configured to turn on when the scan signal is supplied to the first scan line, a first transistor coupled between a second electrode of the second transistor and an anode electrode of the organic light emitting diode, the first transistor configured to control an amount of current supplied to the organic light emitting diode, a third transistor coupled between a gate electrode and a second electrode of the first transistor, the third transistor being configured to turn on when the scan signal is supplied to the first scan line, a fourth transistor coupled between the gate electrode of the first transistor and the initialization power source, the fourth transistor being configured to turn on when the scan signal is supplied to the second scan line, a fifth transistor coupled between a first electrode of the first transistor and the first power source, the fifth transistor being configured to turn off when an emission control signal is supplied to the emission control line, a first capacitor coupled between the gate electrode of the first transistor and the first power source, and a second capacitor coupled between the gate electrode and first electrode of the first transistor.

The pixel may further include a sixth transistor which is coupled between the second electrode of the first transistor and the anode electrode of the organic light emitting diode, and configured to turn off when the emission control signal is supplied to the emission control line. The second capacitor may have a lower capacitance than the first capacitor.

According to another embodiment the present invention, there is provided an organic light emitting display device including a first power source, a second power source, an initialization power source, and emission control lines, the organic light emitting display device including a scan driver for sequentially supplying scan signals to scan lines, a data driver for supplying data signals to data lines, and pixels positioned at crossing regions of the scan lines and the data lines, wherein each of pixels positioned at an i-th horizontal line includes an organic light emitting diode having a cathode electrode coupled to the second power source, a second transistor coupled to a data line and an i-th scan line, the second transistor being configured to turn on when a scan signal is supplied to the i-th scan line, a first transistor coupled between a second electrode of the second transistor and an anode electrode of the organic light emitting diode, the first transistor configured to control an amount of current supplied to the organic light emitting diode, a third transistor coupled between a gate electrode and a second electrode of the first transistor, the third transistor being configured to turn on when the scan signal is supplied to the i-th scan line, a fourth transistor coupled between the gate electrode of the first transistor and the initialization power source, the fourth transistor being configured to turn on when the scan signal is supplied to an (i−1)-th scan line, a fifth transistor coupled between a first electrode of the first transistor and the first power source, the fifth transistor being configured to turn off when an emission control signal is supplied to an i-th emission control line, a first capacitor coupled between the gate electrode of the first transistor and the first power source, and a second capacitor coupled between the gate electrode and the first electrode of the first transistor.

The scan driver may supply the emission control signal to the i-th emission control line so as to overlap with the scan signal supplied to the (i−1)-th and i-th scan lines.

In a pixel and an organic light emitting display device using the pixel according to an embodiment of the present invention, the voltage increment of a gate electrode of a driving transistor is controlled in inverse proportion to the voltage drop of a first power source, so that an image having uniform luminance can be displayed regardless of the load of a pixel unit. Further, the voltage of the gate electrode of the driving transistor is controlled so that the voltage drop of the first power source can be compensated for.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
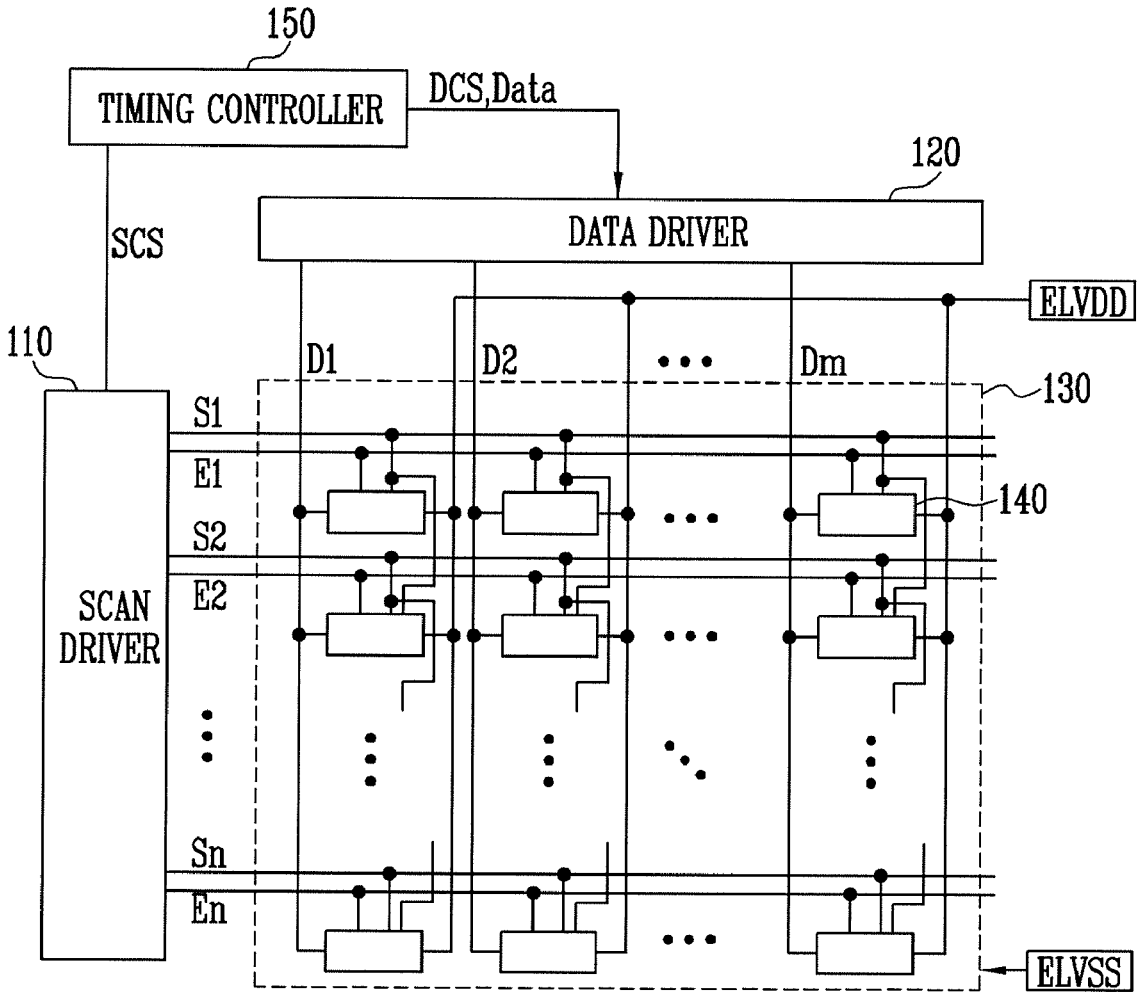
FIG. 1 is a block diagram of an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via a third element. Further, some of the elements that are not essential to a complete understanding of the invention are omitted for clarity. Also, like reference numerals refer to like elements throughout.

FIG. 1 is a block diagram of an organic light emitting display device according to an embodiment of the present invention.

Referring to FIG. 1, the organic light emitting display device according to the embodiment of the present invention includes a display unit 130 including pixels 140 coupled to scan lines S1 to Sn, emission control lines E1 to En, and data lines D1 to Dm; a scan driver 110 for driving the scan lines S1 to Sn and the emission control lines E1 to En; a data driver 120 for driving the data lines D1 to Dm; and a timing controller 150 for controlling the scan driver 110 and the data driver 120.

The scan driver 110 receives a scan driving control signal SCS supplied from the timing controller 150. The scan driver 110 then generates scan signals and sequentially supplies the generated scan signals to the scan lines S1 to Sn. The scan driver 110 generates emission control signals in response to the scan driving control signal SCS and sequentially supplies the generated emission control signals to the emission control lines E1 to En. Here, the width of the emission control signals is set identical to or wider than that of the scan signals.

The data driver 120 receives a data driving control signal DCS supplied from the timing controller 150. The data driver 120 then generates data signals and supplies the generated data signals to the data lines D1 to Dm in synchronization with the scan signals.

The timing controller 150 generates the data driving control signal DCS and the scan driving control signal SCS in response to synchronization signals received from outside thereof. The data driving control signal DCS is supplied to the data driver 120, and the scan driving control signal SCS is supplied to the scan driver 110. The timing controller 150 supplies data Data received from outside thereof to the data driver 120.

A display unit 130 receives a first power source ELVDD and a second power source ELVSS, received from outside thereof, and supplies the first power source ELVDD and the second power source ELVSS to each of the pixels 140. Each of the pixels 140 generates light in response to a data signal. Here, the emission time of each of the pixels 140 is controlled by the emission control signal. The pixels 140 display an image having uniform luminance regardless of the load of the display unit 130.

Figure 2:
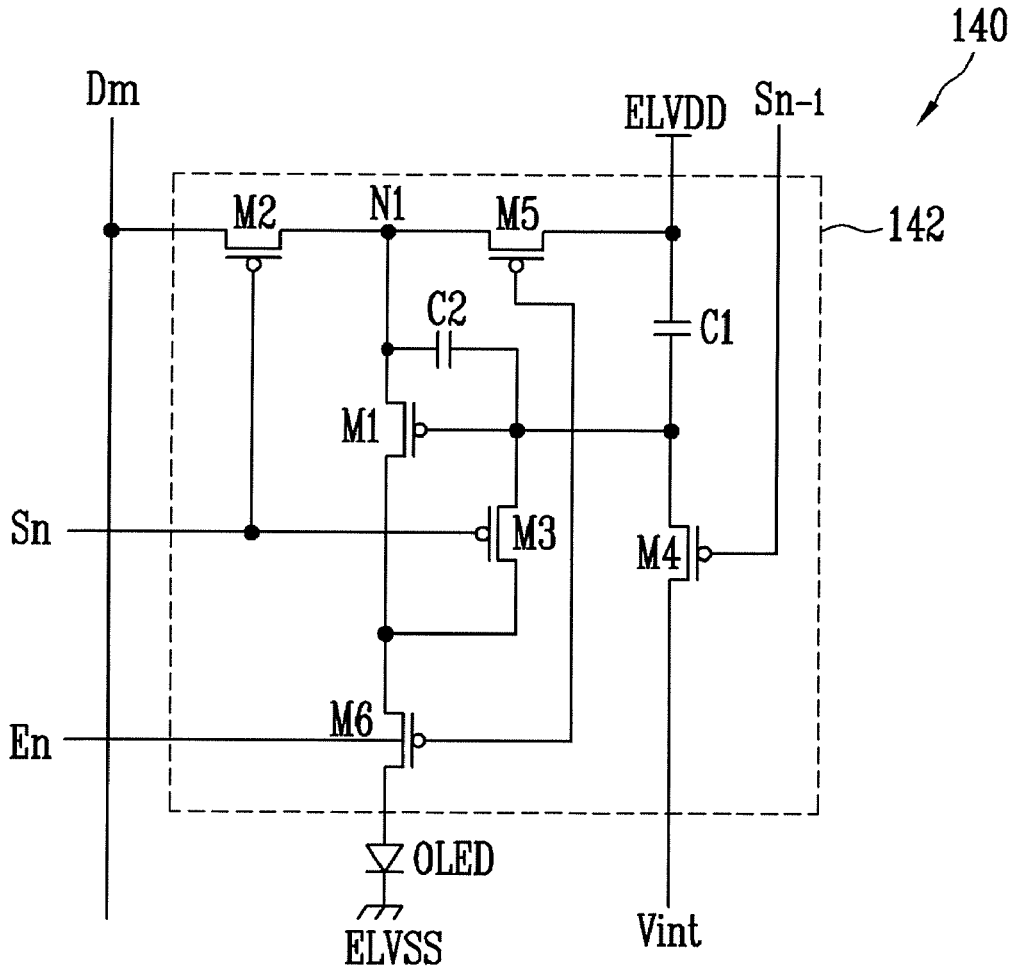
FIG. 2 is a circuit diagram of a pixel according to the embodiment shown in FIG. 1.

FIG. 2 is a circuit diagram of a pixel according to the embodiment shown in FIG. 1. For convenience of illustration, a pixel coupled to an m-th data line Dm, an n-th scan line Sn, an (n−1)-th scan line Sn−1, and an n-th emission control line En is shown in FIG. 2.

Referring to FIG. 2, the pixel 140 according to the described embodiment of the present invention includes an organic light emitting diode OLED and a pixel circuit 142 coupled to the data line Dm, the scan lines Sn−1 and Sn and the emission control line En so as to control an amount of current supplied to the organic light emitting diode OLED.

An anode electrode of the organic light emitting diode OLED is coupled to the pixel circuit 142, and a cathode electrode of the organic light emitting diode OLED is coupled to the second power source ELVSS. Here, the voltage of the second power source ELVSS is set lower than that of the first power source ELVDD. The organic light emitting diode OLED emits light having a luminance corresponding to the amount of current supplied from the pixel circuit 142.

The pixel circuit 142 controls the amount of current supplied to the organic light emitting diode OLED in accordance with a data signal supplied to the data line Dm when a scan signal is supplied to the scan line Sn. To this end, the pixel circuit 142 includes first to sixth transistors M1 to M6, a first capacitor C1 and a second capacitor C2.

A first electrode of the second transistor M2 is coupled to the data line Dm, and a second electrode of the second transistor M2 is coupled to a first node N1. A gate electrode of the second transistor M2 is coupled to the n-th scan line Sn. When a scan signal is supplied to the n-th scan line Sn, the second transistor M2 is turned on to supply the data signal supplied to the data line Dm to the first node N1.

A first electrode of the first transistor M1 (driving transistor) is coupled to the first node N1, and a second electrode of the first transistor M1 is coupled to a first electrode of the sixth transistor M6. A gate electrode of the first transistor M1 is coupled to the first capacitor C1. The first transistor M1 supplies current corresponding to a voltage charged in the first capacitor C1, to the organic light emitting diode OLED.

A first electrode of the third transistor M3 is coupled to the second electrode of the first transistor M1, and a second electrode of the third transistor M3 is coupled to the gate electrode of the first transistor M1. A gate electrode of the third transistor M3 is coupled to the n-th scan line Sn. When a scan signal is supplied to the n-th scan line Sn, the third transistor M3 is turned on to allow the first transistor M1 to be diode-coupled.

A gate electrode of the fourth transistor M4 is coupled to the (n−1)-th scan line Sn−1, and a first electrode of the fourth transistor M4 is coupled to one terminal of the first capacitor C1 and the gate electrode of the first transistor M1. A second electrode of the fourth transistor M4 is coupled to an initialization power source Vint. When a scan signal is supplied to the (n−1)-th scan line Sn−1, the fourth transistor is turned on to change the voltage at the one terminal of the first capacitor C1 and the gate electrode of the first transistor M1 to the voltage of the initialization power source Vint.

A first electrode of the fifth transistor M5 is coupled to the first power source ELVDD, and a second electrode of the fifth transistor M5 is coupled to the first node N1. A gate electrode of the fifth transistor M5 is coupled to the emission control line En. When an emission control signal is not supplied from the emission control line En (i.e., the voltage at the emission control line En is low), the fifth transistor M5 is turned on to allow the first power source ELVDD to be electrically coupled to the first node N1.

The first electrode of the sixth transistor M6 is coupled to the second electrode of the first transistor M1, and a second electrode of the sixth transistor M6 is coupled to the anode electrode of the organic light emitting diode OLED. A gate electrode of the sixth transistor M6 is coupled to the emission control line En. When an emission control signal is not supplied from the emission control line En, the sixth transistor M6 is turned on to supply current supplied from the first transistor M1 to the organic light emitting diode OLED.

The first capacitor C1 is coupled between the gate electrode of the first transistor M1 and the first power source ELVDD. A voltage corresponding to the threshold voltage of the transistor M1 and the data signal is charged in the first capacitor C1.

The second capacitor C2 is coupled between the first electrode and the gate electrode of the first transistor M1. The second capacitor C2 controls the voltage of the gate electrode of the first transistor M1 corresponding to the voltage of the first power source ELVDD. In operation, the second capacitor C2 controls the voltage increment of the gate electrode of the first transistor M1 in inverse proportion to the voltage drop of the first power source ELVDD. For example, when the voltage drop of the first power source ELVDD is high, the second capacitor C2 sets the voltage increment of the gate electrode of the first transistor M1 to be low. When the voltage drop of the first power source ELVDD is low, the second capacitor C2 sets the voltage increment of the gate electrode of the first transistor M1 to be high.

The second capacitor C2 has a lower capacitance than the first capacitor C1. That is, the second capacitor C2 controls the voltage of the gate electrode of the first transistor M1 corresponding to the voltage of the first power source ELVDD, and is set to have a lower capacitor than the first capacitor C1 in which the voltage corresponding to the threshold voltage of the transistor M1 and the data signal is charged.

Figure 3:
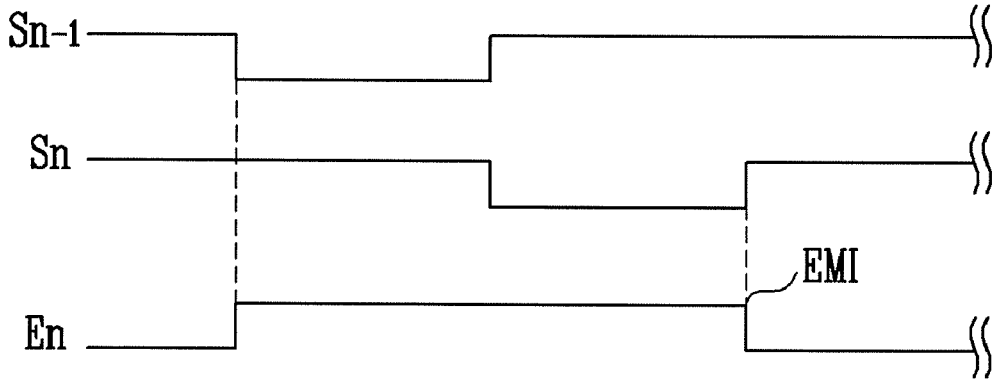
FIG. 3 is a waveform diagram illustrating a driving method of the pixel according to the embodiment shown in FIG. 2.

FIG. 3 is a waveform diagram illustrating a driving method of the pixel shown in FIG. 2.

An operation of the pixel 140 will be described in detail in conjunction with FIGS. 2 and 3. First, an emission control signal EMI is supplied to the emission control line En, and the fifth and sixth transistors M5 and M6 are turned off. At this time, the first power source ELVDD is electrically cut off from the first transistor M1, and therefore, current is not supplied to the organic light emitting diode OLED.

A scan signal is supplied to the (n−1)-th scan line Sn−1, and the fourth transistor M4 is turned on. When the fourth transistor M4 is turned on, the voltage of the initialization power source Vint is supplied to the one terminal of the first capacitor C1 and the gate electrode of the first transistor M1. In other words, when the fourth transistor M4 is turned on, the voltage at the one terminal of the first capacitor C1 and the gate electrode of the first transistor M1 is initialized to be at the voltage of the initialization power source Vint. Here, the voltage of the initialization power source Vint is set lower than that of a data signal.

Thereafter, a scan signal is supplied to the n-th scan line Sn. When the scan signal is supplied to the n-th scan line Sn, the second and third transistors M2 and M3 are turned on. When the third transistor M3 is turned on, the first transistor M1 is diode-coupled. When the second transistor M2 is turned on, a data signal supplied to the data line Dm is supplied to the first node N1 via the second transistor M2. At this time, the voltage at the gate of the first transistor M1 remains at the voltage of the initialization power source Vint (i.e., the voltage at the gate of the first transistor M1 is set lower than that of the data signal supplied to the first node N1), and hence the first transistor M1 is turned on.

When the first transistor M1 is turned on, the data signal supplied to the first node N1 is supplied to the one terminal of the first capacitor C1 via the first and third transistors M1 and M3. Here, since the data signal is supplied to the first capacitor C1 via the diode-coupled first transistor M1, a voltage corresponding to the data signal and the threshold voltage of the first transistor M1 is charged in the first capacitor C1.

After the voltage corresponding to the data signal and the threshold voltage of the first transistor M1 is charged in the first capacitor C1, the supply of the emission control signal EMI is stopped, and the fifth and sixth transistors M5 and M6 are turned on.

When the fifth transistor M5 is turned on, the voltage of the first power source ELVDD is supplied to the first node N1. When the voltage of the first power source ELVDD is supplied to the first node N1, the voltage of the gate electrode of the first transistor M1 is increased by the second capacitor C2. At this time, the voltage increment of the gate electrode of the first transistor M1 is determined by the voltage drop of the first power source ELVDD.

For example, when the voltage of the first power source ELVDD is set as 10V and a voltage drop of 5V occurs, the second capacitor C2 allows the voltage of the gate electrode of the first transistor M1 to be increased by a first voltage, corresponding to 5V. When there is no voltage drop of the first power source ELVDD, the second capacitor C2 allows the voltage of the gate electrode of the first transistor M1 to be increased by a second voltage higher than the first voltage, corresponding to 10V. If the voltage of the gate electrode of the first transistor M1 is controlled corresponding to the voltage drop of the first power source ELVDD, an image having a generally uniform luminance can be displayed regardless of the voltage drop of the first power source ELVDD. Similarly, an image having a generally uniform luminance can be displayed regardless of the load of the display unit 130.

More specifically, as the voltage drop of the first power source ELVDD is increased, the voltage increment of the gate electrode of the first transistor M1 is decreased. In this case, the amount of current supplied to the organic light emitting diode OLED is increased as compared to a case where there is no change to the voltage increment of the gate electrode of the first transistor M1, and accordingly, the voltage drop of the first power source ELVDD can be compensated to some extent.

When the fifth and sixth transistors M5 and M6 are turned on, a current path is formed from the first power source ELVDD to the organic light emitting diode OLED. In this case, the first transistor M1 controls the amount of current that flows from the first power source ELVDD to the organic light emitting diode OLED, corresponding to the voltage applied to the gate electrode of the first transistor M1.

Figure 4A:
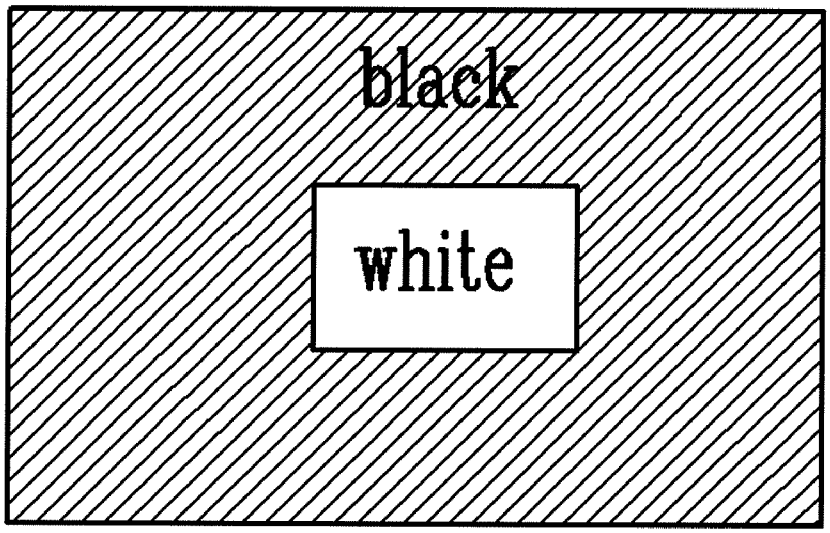
FIGS. 4A and 4B are diagrams showing loads of a pixel unit according to an embodiment of the present invention.
Figure 4B:
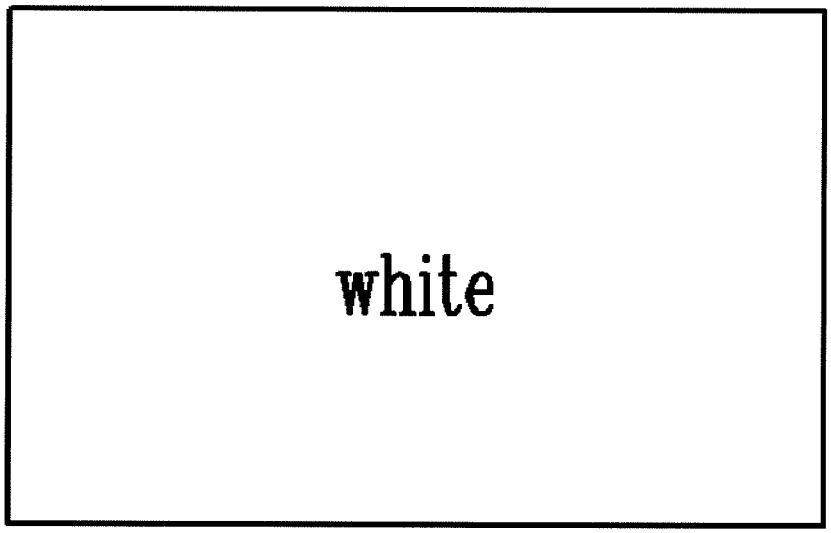

FIGS. 4A and 4B are diagrams showing loads of a display unit according to an embodiment of the present invention.

FIG. 4A shows a case in which only some pixels of the display unit, which are positioned at a central portion of the display unit, emit light. FIG. 4B shows a case in which all the pixels included in the display unit emit light.

When all the pixels included in the display unit emit light as shown in FIG. 4B, the amount of current supplied to the pixels is increased, and therefore, the first power source ELVDD has a high voltage drop. On the other hand, when only some pixels included in the display unit emit light as shown in FIG. 4A, the total amount of current supplied to the pixels is decreased, and therefore, the voltage drop of the first power source ELVDD is set lower than that of FIG. 4B.

When the first power source ELVDD has a high voltage drop as shown in FIG. 4B, the voltage increment of the first transistor M1 is set low by the second capacitor C2 included in each of the pixels. On the other hand, when the first power source ELVDD has a low voltage drop as shown in FIG. 4A, the voltage increment of the first transistor M1 is set high by the second capacitor included in each of the pixels. In this case, the voltage drop of the first power source ELVDD is compensated, so that an image having a generally uniform luminance can be displayed from the pixels regardless of the load of the pixel unit.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel of an organic light emitting display comprising a first power source, a second power source, an initialization power source, a data line, a first scan line, a second scan line, and an emission control line, the pixel comprising:

an organic light emitting diode having a cathode electrode coupled to the second power source;

a second transistor coupled to the data line and the first scan line, the second transistor being configured to turn on when a scan signal is supplied to the first scan line;

a first transistor coupled between a second electrode of the second transistor and an anode electrode of the organic light emitting diode, the first transistor being configured to control an amount of current supplied to the organic light emitting diode;

a third transistor coupled between a gate electrode and a second electrode of the first transistor, the third transistor being configured to turn on when the scan signal is supplied to the first scan line;

a fourth transistor coupled between the gate electrode of the first transistor and the initialization power source, the fourth transistor being configured to turn on when the scan signal is supplied to a second scan line;

a fifth transistor coupled between a first electrode of the first transistor and the first power source, the fifth transistor being configured to turn off when an emission control signal is supplied to the emission control line;

a first capacitor coupled between the gate electrode of the first transistor and the first power source; and a second capacitor coupled between the gate electrode and the first electrode of the first transistor.

2. The pixel of claim 1, further comprising a sixth transistor coupled between the second electrode of the first transistor and the anode electrode of the organic light emitting diode, the sixth transistor being configured to turn off when the emission control signal is supplied to the emission control line.

3. The pixel of claim 1, wherein the initialization power source has a lower voltage than the data signal supplied to the data line.

4. The pixel of claim 1, wherein the second capacitor has a lower capacitance than the first capacitor.

5. The pixel of claim 1, wherein the first power source has a higher voltage than the second power source.

6. An organic light emitting display device comprising a first power source, a second power source, an initialization power source, data lines, scan lines, and emission control lines, the organic light emitting display device further comprising:

a scan driver for sequentially supplying scan signals to the scan lines;

a data driver for supplying data signals to the data lines; and pixels positioned at crossing regions of the scan lines and the data lines, wherein each of pixels positioned at an i-th horizontal line comprises:

an organic light emitting diode having a cathode electrode coupled to the second power source;

a second transistor coupled to a respective one of the data lines and an i-th scan line from among the scan lines, the second transistor being configured to turn on when a respective one of the scan signals is supplied to the i-th scan line;

a first transistor coupled between a second electrode of the second transistor and an anode electrode of the organic light emitting diode, the first transistor being configured to control an amount of current supplied to the organic light emitting diode;

a third transistor coupled between a gate electrode and a second electrode of the first transistor, the third transistor being configured to turn on when the respective one of the scan signals is supplied to the i-th scan line;

a fourth transistor coupled between the gate electrode of the first transistor and the initialization power source, the fourth transistor being configured to turn on when a respective one of the scan signals is supplied to an (i−1)-th scan line from among the scan lines;

a fifth transistor coupled between a first electrode of the first transistor and the first power source, the fifth transistor being configured to turn off when an emission control signal is supplied to an i-th emission control line from among the emission control lines;

a first capacitor coupled between the gate electrode of the first transistor and the first power source; and a second capacitor coupled between the gate electrode and the first electrode of the first transistor.

7. The organic light emitting display device of claim 6, further comprising a sixth transistor coupled between the second electrode of the first transistor and the anode electrode of the organic light emitting diode, the sixth transistor being configured to turn off when the emission control signal is supplied to the i-th emission control line.

8. The organic light emitting display device of claim 6, wherein the initialization power source has a lower voltage than the data signal.

9. The organic light emitting display device of claim 6, wherein the second capacitor has a lower capacitance than the first capacitor.

10. The organic light emitting display device of claim 6, wherein the first power source has a higher voltage than the second power source.

11. The organic light emitting display device of claim 6, wherein the scan driver is configured to supply the emission control signal to the i-th emission control line so as to overlap with the scan signals supplied to the (i−1)-th and i-th scan lines.

* * * * *